US006021691A

United States Patent [19]

Wilkerson, Jr.

[11] Patent Number: 6,021,691

[45] Date of Patent: Feb. 8, 2000

[54] MANUAL OVERRIDE FOR POWER WINDOWS

[76] Inventor: Clarence Wilkerson, Jr., 7806 Briarwood Dr., New Orleans, La. 70128

[21] Appl. No.: 09/096,262

[22] Filed: Jun. 11, 1998

[51] Int. Cl.[7] ..... G05G 1/00; G05G 5/06; E05F 15/00

[52] U.S. Cl. ..... 74/547; 74/543; 74/545; 74/625; 74/528; 74/523; 49/139; 49/140

[58] Field of Search ..... 74/625, 640, 501.6, 74/523, 528, 543–548; 49/139, 140, 362, 324; 192/48.1, 48.2

[56] References Cited

U.S. PATENT DOCUMENTS

| | | | |
|---|---|---|---|
| 2,324,145 | 7/1943 | Floraday | 49/139 |
| 2,621,543 | 12/1952 | Rossmann | 74/625 |
| 2,621,544 | 12/1952 | Rossmann | 74/626 |
| 3,174,742 | 3/1965 | Stelzer | 268/124 |
| 3,706,163 | 12/1972 | Pickles | 49/362 |
| 3,791,071 | 2/1974 | Niklaus | 49/140 |
| 4,074,463 | 2/1978 | Colanzi | 74/501.5 R |
| 4,085,629 | 4/1978 | Fogarollo | 74/625 |
| 4,182,078 | 1/1980 | Bartholomew | 49/139 |
| 4,257,192 | 3/1981 | Bartholomew | 49/140 |
| 4,420,185 | 12/1983 | Bienert et al. | 49/324 X |
| 4,429,591 | 2/1984 | Zuch et al. | 192/48.1 X |
| 4,481,735 | 11/1984 | Jentoff | 49/325 |
| 4,553,656 | 11/1985 | Lense | 192/142 |

*Primary Examiner*—Vinh T. Luong
*Attorney, Agent, or Firm*—Henderson & Sturm

[57] ABSTRACT

A window operating system for moving a vehicle window up and down that includes an electric drive motor having a gear coupled to a window movement mechanism through a magnetic clutch assembly wherein the drive gear includes a crank extending outwardly therefrom and through the door facing surface and is selectively connectable to a roll up crank having a fold out handle and a protruding socket member. The door facing surface includes a cavity or chamber into which the emergency crank can be stored and rapidly retrieved in an emergency. The magnetic clutch is only engaged when the power is supplied to the electric motor in either direction.

1 Claim, 1 Drawing Sheet

MANUAL OVERRIDE FOR POWER WINDOWS

BACKGROUND OF THE INVENTION

1. Field of the Invention

The present invention relates to the field of power windows, and more particularly to a power window including a manual override for emergency situations.

2. Description of Related Art

As can be seen by reference to the following U.S. Pat. Nos. 2,621,544; 3,791,071; 4,085,629; 4,182,078; 4,257,192; 4,553,656, the prior art is replete with myriad and diverse manual override systems for power windows.

While all of the aforementioned prior art constructions are more than adequate for the basic purpose and function for which they have been specifically designed, they are uniformly deficient with respect to their failure to provide a simple, efficient, and practical manual override for automobile power windows.

As a consequence of the foregoing situation, there has existed a longstanding need for a new and improved manual override for power windows and the provision of such a construction is a stated objective of the present invention.

BRIEF SUMMARY OF THE INVENTION

Briefly stated, the present invention provides a window operating system for moving a vehicle window up and down that includes an electric drive motor having a gear coupled to a window movement mechanism through a magnetic clutch assembly wherein the drive gear includes a crank extending outwardly therefrom and through the door facing surface and is selectively connectable to a roll up crank having a fold out handle and a protruding socket member. The door facing surface includes a cavity or chamber into which the emergency crank can be stored and rapidly retrieved in an emergency. The magnetic clutch is only engaged when the power is supplied to the electric motor in either direction.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
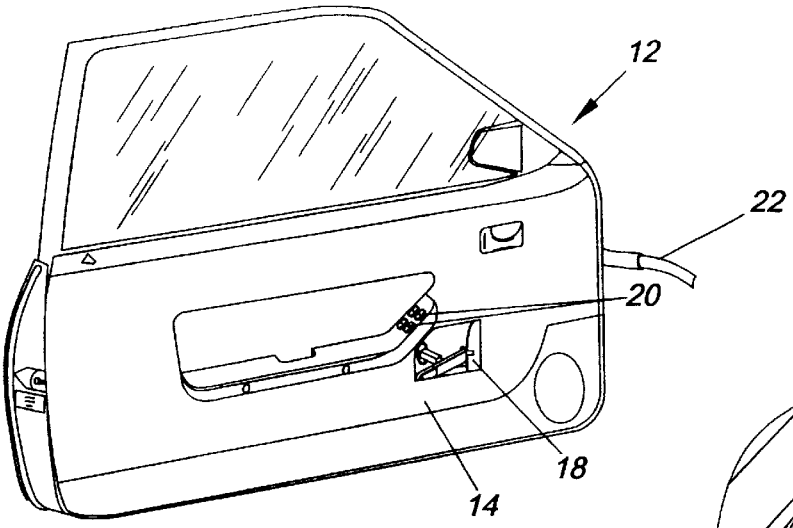
FIG. 1 is a perspective view of an automobile door including the power window manual override of the present invention.

As can be seen by reference to the drawings, and in particularly to FIG. 1, that forms the basis of the present invention is designated generally by the reference number 10.

Figure 2:
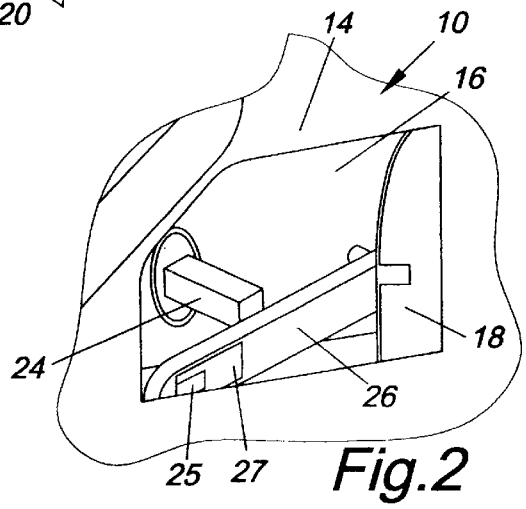
FIG. 2 is an enlarged partial perspective view showing the access door to the manual override.

As illustrated in FIGS. 1 and 2, the manual override system 10 is attached to a vehicle door 12. The door 12 includes an interior door panel 14, and an access opening 16 covered by a selectively movable sliding door 18. Electric window control buttons 20 are carried on the door panel 14, and power to the central buttons 20 is supplied by wiring 22 electrically connected to the vehicle power supply.

As best shown in FIG. 2, when the sliding door 18 is opened, the square ended crank shaft 24 and associated crank handle 26 are readily accessible to the driver.

Figure 3:
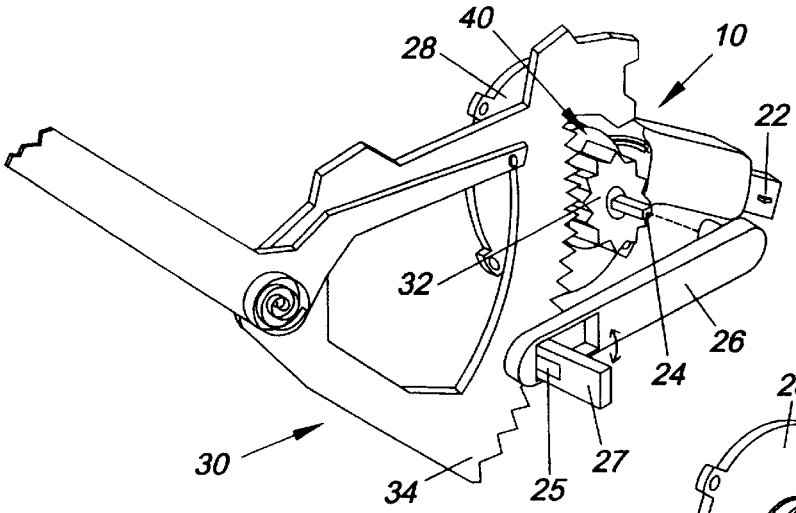
FIG. 3 is a greatly enlarged partial perspective view of the components of the manual override.
Figure 4:
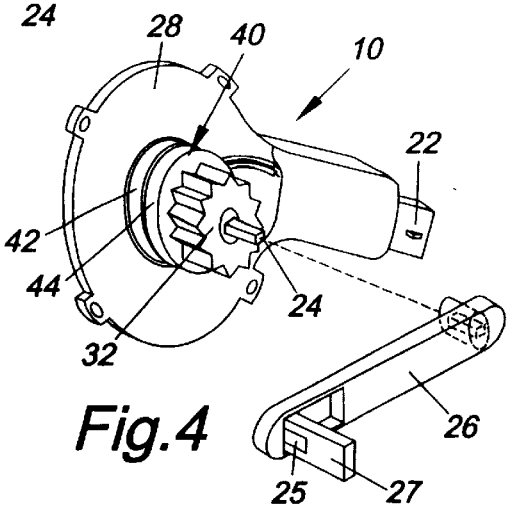
FIG. 4 is a perspective view showing the magnetic clutch interposed between the drive motor and the power window drive gear.

It is an objective of this invention to allow the user of an automobile the ability to manually roll down the windows of a vehicle that is equipped with power electric windows when power to the window drive motor is off. The electric windows are operated by a DC gear motor system 28 that is mechanically attached to the window crank mechanism 30 of an automobile illustrated in FIG. 3. Because of the force necessary to move the reduction gears of the DC gear motor is difficult, if not impossible, to move the electrically powered window manually with a hand operated window crank. In all automotive electric window systems, a small drive gear 32 makes contact with a larger driven gear 34 on the window movement mechanism 30.

It is desirable to have a back up manual system to move the window up and down in the event of power or motor failure. The manual override system 10 provides this option through use of magnetic clutch assembly 40 that works in conjunction with a removably window crank 26 and the drive motor 28. The removable hand window crank 26 folds almost flat so that is may be stored behind that recess door panel 18 of the vehicle. The recess 16 is covered by a sliding door 18 that is pushed to the side in order to reveal not only the stored, folded window crank handle 26, but also access to the square stem shaft 24 that the crank 26 attaches to. To operate the electric window manually, the vehicle operator simply slips the mating female square drive socket of the crank 26 over the square drive protrusion of the shaft 24. The shaft 24 is directly attached to the small drive gear 32 that moves the window movement mechanism 30 up and down. The window is easily moved by hand because the shaft of the DC gear motor is connected to the drive gear 32 via a magnetic clutch mechanism 40.

The magnetic clutch 40 is an off the shelf device that may be thought of as two discs 42 and 44 that are not quite touching face to face, but are connected to the same shaft, one over the other in rotating bearing fashion. Both the discs may rotate about the common shaft independently. If one of the disc is a permanent magnet, and the other disc as an electromagnet, they may be caused to make physical face to face contact is electricity is applied to the electromagnet on one of the discs. Once this occurs, mechanical power may be transferred from one disc to the other. If power is not applied mechanical power is disconnected and not transferred.

Power from the shaft of the motor is mechanically disconnected from the drive gear 32. Energy from the drive shaft of the gear motor is only transferred to the drive gear 32 of the window when voltage is applied to the magnetic clutch 40. This arrangement provides the mechanical connection of the DC gear motor shaft only when power is provided to the motor 28 and the magnetic clutch 40. Also, the drive gear 32 of the window may be moved manually by means of the window crank 26 because the shaft of the DC gear motor is not actually connected to the window drive gear 32 when power is not applied.

The specific design provides a common shaft for the drive gear 32 that is connected to the secondary gear 34 that moves the window assembly 30. One side of the common gear shaft assembly is connected to the magnetic clutch 40 while the other side has a square male drive shaft 24 that connects to the removably window crank 26.

The manual override system 20 may be manufactured as an after market product or included in new vehicles at the factory level.

An operator of a vehicle equipped with the manual override system 10 uses the electrically powered windows in the usual manner. In the event of a vehicle power failure or motor failure, the operator slides the access door 18 to the side, removes the folded window crank handle 26, which pivots on hinge 25 and slides it over the shaft 24. The unfolded end 27 of the window crank handle 26 is then used as a conventional window crank as it is in any conventional vehicle.

Use of the manual override system 10 in vehicles equipped with electric windows provides an extra measure of safety. For example, electric windows do not operate under water, preventing someone in a vehicle accident from rolling down the window. Because the motor is mechanically disconnected from the window when power is not applied, the window may be rolled down in the same manner as a manually operated vehicle window. This makes it possible to operate the window system under water under conditions where that is possible.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A manual override system adapted for use with a power window, comprising:

a drive motor;

a window movement mechanism including a drive gear and a driven gear, the drive gear being selectively drivably coupled to the drive motor;

a clutch interposed between the drive motor and the drive gear;

a crank adapted to engage and manually drive the drive gear wherein the drive gear is positioned in a vehicle door behind a sliding access panel, wherein a square shaft protrudes out from the drive gear, and the crank matingly engages the square shaft, wherein the crank is stored behind the access panel when not in use, and wherein the crank includes an end portion pivotally attached to the crank whereby the end portion may be selectively pivoted outwardly and grasped by a user of the crank.

* * * * *